US007875235B2

(12) United States Patent
Ebner et al.

(10) Patent No.: US 7,875,235 B2
(45) Date of Patent: Jan. 25, 2011

(54) METHOD FOR BATCHWISE HEAT TREATMENT OF GOODS TO BE ANNEALED

(75) Inventors: Peter Ebner, Leonding (AT); Heribert Lochner, Leonding (AT)

(73) Assignee: Ebner Industrieofenbau Gesellschaft m.b.H., Leonding (AT)

( * ) Notice: Subject to any disclaimer, the term of this patent is extended or adjusted under 35 U.S.C. 154(b) by 370 days.

(21) Appl. No.: 11/919,689

(22) PCT Filed: May 11, 2006

(86) PCT No.: PCT/AT2006/000194

§ 371 (c)(1),
(2), (4) Date: Oct. 31, 2007

(87) PCT Pub. No.: WO2006/119526

PCT Pub. Date: Nov. 16, 2006

(65) Prior Publication Data

US 2009/0026666 A1 Jan. 29, 2009

(30) Foreign Application Priority Data

May 12, 2005 (AT) ..... 813/2005

(51) Int. Cl.
*C21D 9/63* (2006.01)
*C21D 9/00* (2006.01)
*C21D 1/00* (2006.01)

(52) U.S. Cl. ..... 266/44; 148/582; 148/591; 148/606; 148/615; 148/625; 148/633; 148/634; 148/687; 148/703; 148/708; 148/712; 219/651; 219/686; 219/707; 219/121.33; 219/121.51; 219/121.55

(58) Field of Classification Search ..... 148/582, 148/591, 606, 615, 625, 633–634, 667; 219/651, 219/686, 707, 121.33; 266/44
See application file for complete search history.

(56) References Cited

U.S. PATENT DOCUMENTS 2,673,821 A * 3/1954 Stutzman ..... 148/235

(Continued)

FOREIGN PATENT DOCUMENTS

DE 43 36 711 5/1995

(Continued)

OTHER PUBLICATIONS

International Search Report.

*Primary Examiner*—Roy King
*Assistant Examiner*—Lois Zheng
(74) *Attorney, Agent, or Firm*—Collard & Roe, P.C.

(57) ABSTRACT

A method is described for batchwise heat treatment of goods to be annealed which are heated in a heating chamber after scavenging air with a scavenging gas under protective gas to a predetermined treatment temperature, with the protective gas being conveyed through the heating chamber depending on the occurrence of impurities in different quantities. In order to enable the economic use of protective gas, it is proposed that the protective gas which is withdrawn from the heating chamber after the main occurrence of impurities and which is loaded with a residual quantity of impurities is conveyed, optionally after intermediate storage, into the heating chamber during the main occurrence of impurities of a subsequent batch before non-loaded protective gas is introduced into the heating chamber.

3 Claims, 2 Drawing Sheets

U.S. PATENT DOCUMENTS

| | | | | | |
|---|---|---|---|---|---|
| 4,648,914 | A | * | 3/1987 | Stanescu et al. | 148/596 |
| 5,158,625 | A | * | 10/1992 | Lhote et al. | 148/625 |
| 5,730,813 | A | | 3/1998 | Scheuermann | |

FOREIGN PATENT DOCUMENTS

| | | | |
|---|---|---|---|
| DE | 103 47 312 | | 4/2005 |
| EP | 0 794 263 | | 9/1997 |
| GB | 332656 | | 7/1930 |
| GB | 484569 | | 5/1938 |
| JP | 58-055523 | | 4/1983 |
| JP | 62-177126 | | 8/1987 |
| JP | 6-306454 | | 11/1994 |
| JP | 09-235619 | * | 9/1997 |

* cited by examiner

Temperature $T_1$
$T_2$
Vaporation Quantity
9
m
$t_1$
Time [t]
10

12
a
d
b
13
c
11
Gas Quantity
$t_1$
Time [t]

METHOD FOR BATCHWISE HEAT TREATMENT OF GOODS TO BE ANNEALED

CROSS REFERENCE TO RELATED APPLICATIONS

Applicants claim priority under 35 U.S.C. §119 of Austrian Application No. A 813/2005 filed May 12, 2005. Applicants also claim priority under 35 U.S.C. §365 of PCT/AT2006/000194 filed May 11, 2006. The international application under PCT article 21(2) was not published in English.

FIELD OF THE INVENTION

The invention relates to a method for batchwise heat treatment of goods to be annealed which are heated in a heating chamber after scavenging air with a scavenging gas under protective gas to a predetermined treatment temperature, with the protective gas being conveyed through the heating chamber depending on the occurrence of impurities in different quantities.

DESCRIPTION OF THE PRIOR ART

Metal strips and wires are subjected to heat treatment under protective gas for recrystallization, which gas should especially prevent oxidation processes on the surface of the annealing good by atmospheric oxygen. The air is scavenged at first from the heating chamber by a non-combustible gas, preferably nitrogen, until the oxygen content has been decreased to a permissible maximum amount before the heat treatment is performed under a protective gas such as nitrogen or hydrogen. Since lubricant residues usually adhere to the annealing goods, said impurities are vaporized during a vaporization phase during the heating of the annealing good to the treatment temperature, with the vaporized impurities being diluted and scavenged by the protective gas conveyed through the heating chamber. For economic reasons, the quantity of the protective gas conveyed through the heating chamber is controlled depending on the respective obtained quantity of vaporized impurities. The vaporized quantity of impurities rapidly increases with the rise of the surface temperature of the annealing good, which is followed by a decrease again after the vaporization of the main quantity of impurities, despite rising surface temperatures. The progress of the vaporized quantities of impurities over the vaporization phase determines the largest volume flow of protective gas through the heating chamber during the main occurrence of vaporizing impurities, with the quantity of shield gas conveyed through the heating chamber being reducible with increasing reduction of vaporizing impurities and increasing dilution of the impurities in the protective gas, until towards the end of the heat treatment only a remainder of impurities is present in the heating chamber which no longer impairs the treatment of the annealing good, so that during the cooling of the annealing good it is only necessary to compensate a heat-induced decrease in volume in order to maintain a predetermined minimum pressure in the heating chamber. Despite this adjustment of the quantity of protective gas conveyed through the heating chamber to the vaporization phase, the quantity of protective gas to be employed for each batch remains comparatively high.

SUMMARY OF THE INVENTION

The invention is thus based on the object of providing a method of the kind mentioned above for the heat treatment of annealing goods in such a way that the quantity of protective gas required for each batch can be reduced.

This object is achieved by the invention in such a way that the protective gas which is withdrawn from the heating chamber after the main occurrence of impurities and which is loaded with a residual quantity of impurities is conveyed into the heating chamber, optionally after intermediate storage, during the main occurrence of impurities of a subsequent batch before non-loaded protective gas is introduced into the heating chamber.

The invention is based on the finding that a respectively high degree of purity of the protective gas is only necessary at the end of the heat treatment of the annealing good, so that during the main occurrence of impurities protective gas loaded with such impurities can be conveyed through the heating chamber as long as the loading is limited and a sufficient dilution effect is ensured. For this reason, the protective gas of a following batch which is withdrawn from the heating chamber after the main occurrence of the impurities and is loaded with a residual quantity of impurities can be conveyed during the main occurrence of impurities into the heating chamber again, so that a considerable portion of the otherwise discarded quantity of protective gas from a preceding batch can be used again and can replace a portion of the otherwise required non-loaded protective gas without impairing the treatment of the annealing good. The non-loaded protective gas will only be used to an extent which at the end of the heat treatment allows a protective gas atmosphere which is substantially free from impurities, as is also present in conventional heat treatments. In order to enable the use of the protective gas which is drawn off during the heat treatment of a batch and is loaded with limited residual content of impurities for the heat treatment of a subsequent batch, the protective gas withdrawn from a heating chamber can be introduced into a further parallel heating chamber which is operated in a time-staggered manner concerning charging however. It is understood that it is also possible to intermediately store the protective gas withdrawn from a heating chamber, which ensures the guidance of the protective gas in accordance with the invention when only one single heating chamber is provided and makes the charging of several heating chambers independent from each other in a temporal respect.

Similarly, the scavenging gas which towards the end of the scavenging process is still loaded with a residual quantity of oxygen can be used during a following batch. For the use of said scavenging gas with a residual load of impurities during a following batch it will depend on whether or not the scavenging gas is also used as a protective gas. When nitrogen is used as a scavenging and protective gas, the scavenging gas withdrawn from the heating chamber can also be introduced into the heating chamber during the heat treatment following the scavenging process in the case of a respectively low contamination by a residual content of oxygen, which is not possible in the case of different gases for scavenging and heat treatment.

Since the occurrence of impurities decreases asymptotically in the discharge section of the vaporization phase during the heat treatment of annealing goods with surface impurities, an average contamination is obtained for the intermediately stored protective gas which is withdrawn from the heating chamber, which contamination must be upwardly limited in view of the conditions in the heating chamber during the vaporization phase. To ensure that a predetermined upper limit value can be maintained in a simple manner, the protective or scavenging gas which is loaded with impurities can be intermediately stored once its percentage of impurities falls below an upper threshold value, which lies 10% over the average percentage of contaminations of the intermediate protective or scavenging gas.

BRIEF DESCRIPTION OF THE DRAWINGS

The method in accordance with the invention is now explained in closer detail by reference to the drawing, wherein.

DESCRIPTION OF THE PREFERRED EMBODIMENT

Figure 1:
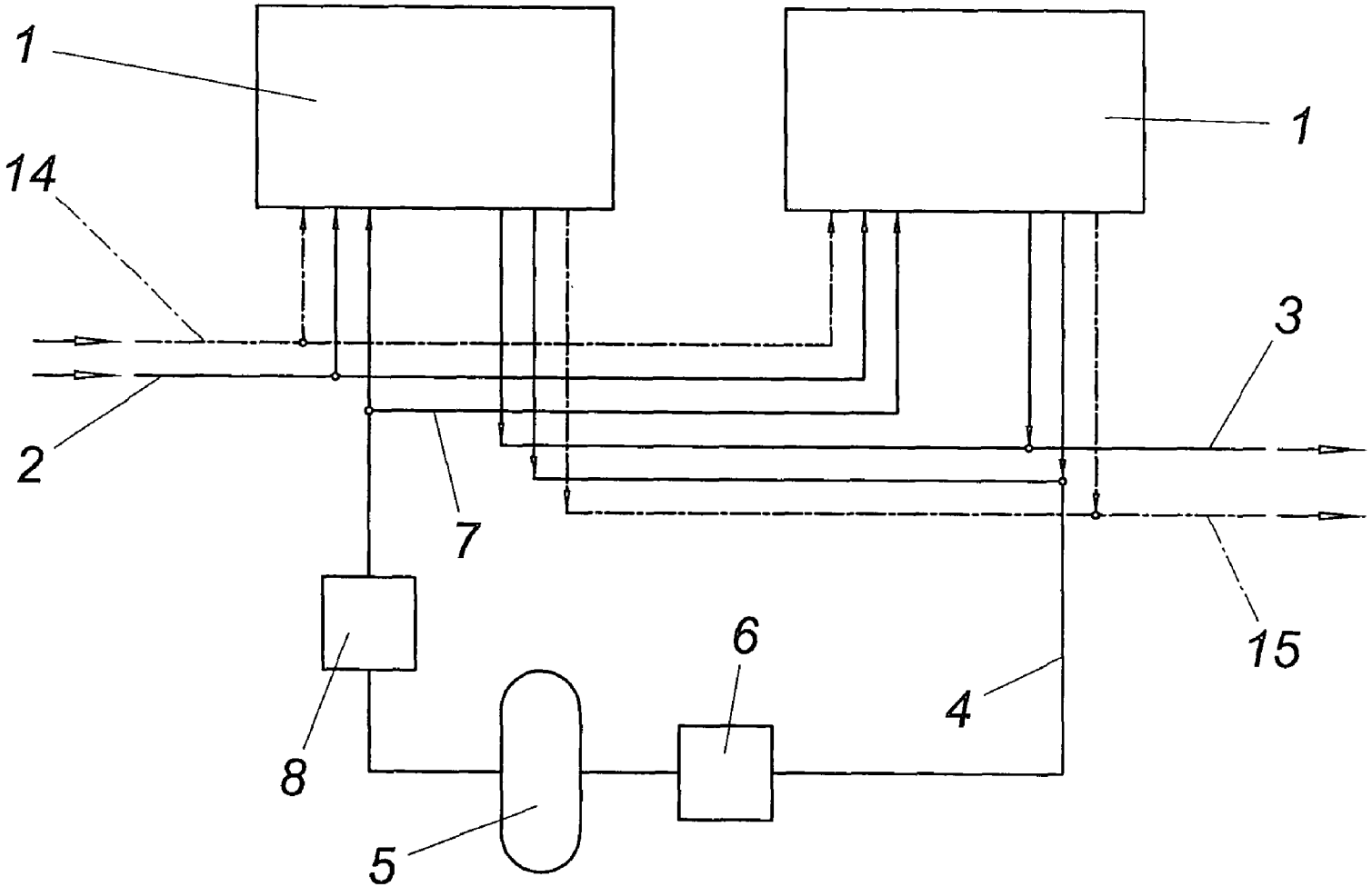
FIG. 1 shows an installation for the heat treatment of annealing goods according to the method in accordance with the invention in a schematic block diagram.

In accordance with FIG. 1, heating chambers 1 are provided for the heat treatment of annealing goods such as metal strip or metal wire bunches, which heating chambers are charged in batches with the annealing goods. Said heating chambers 1 which are formed by hood-type annealing furnaces for example are connected in the conventional manner to a protective gas feed line 2 and a protective gas discharge line 3. Moreover, a discharge gas line 4 is provided through which a storage reservoir 5 can be loaded, with the help of a compressor 6 according to the embodiment. The storage reservoir is unloaded via a line 7 which is connected to the heating chambers 1 and which is connected via a device 8 for pressure regulation with the storage reservoir 5.

Figure 2:
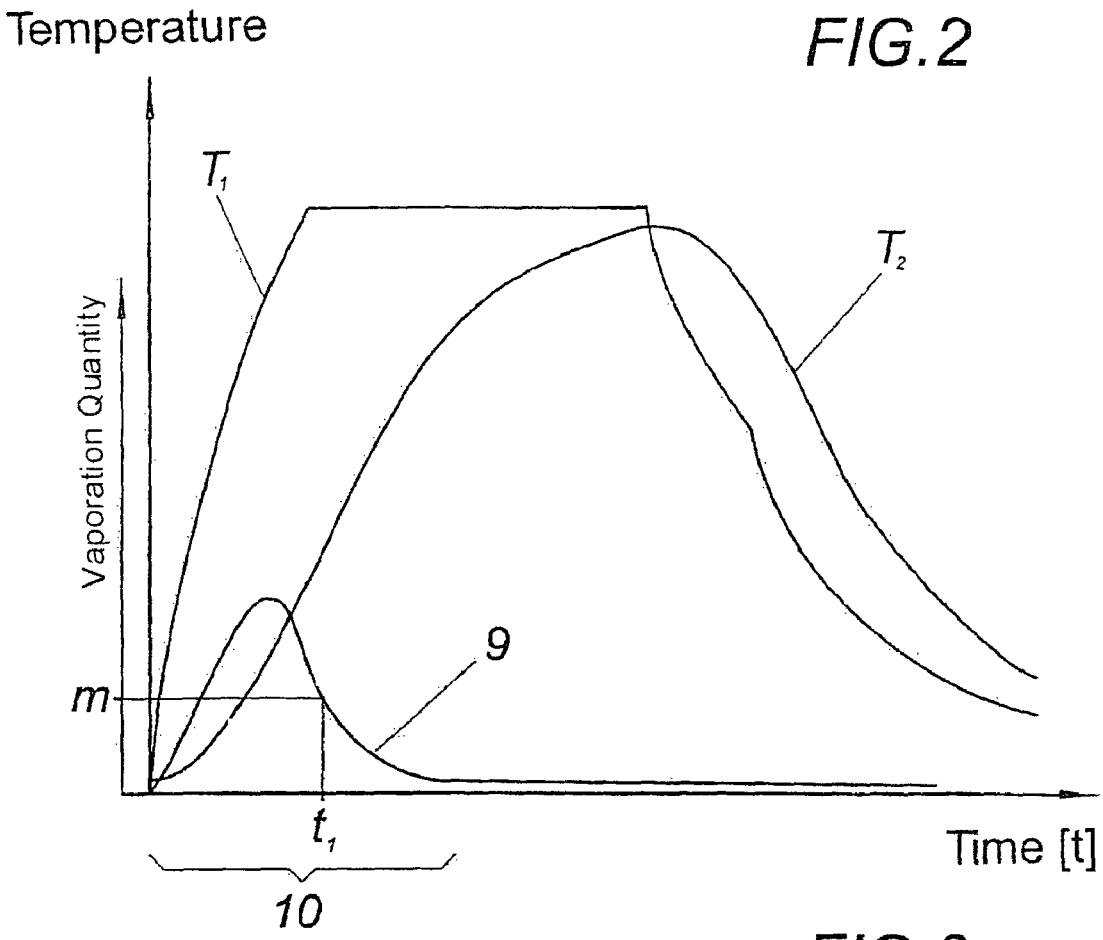
FIG. 2 shows the temperature curve of the annealing good over the treatment time on its surface and in its interior and the occurring percentage of vaporizing impurities.
Figure 3:
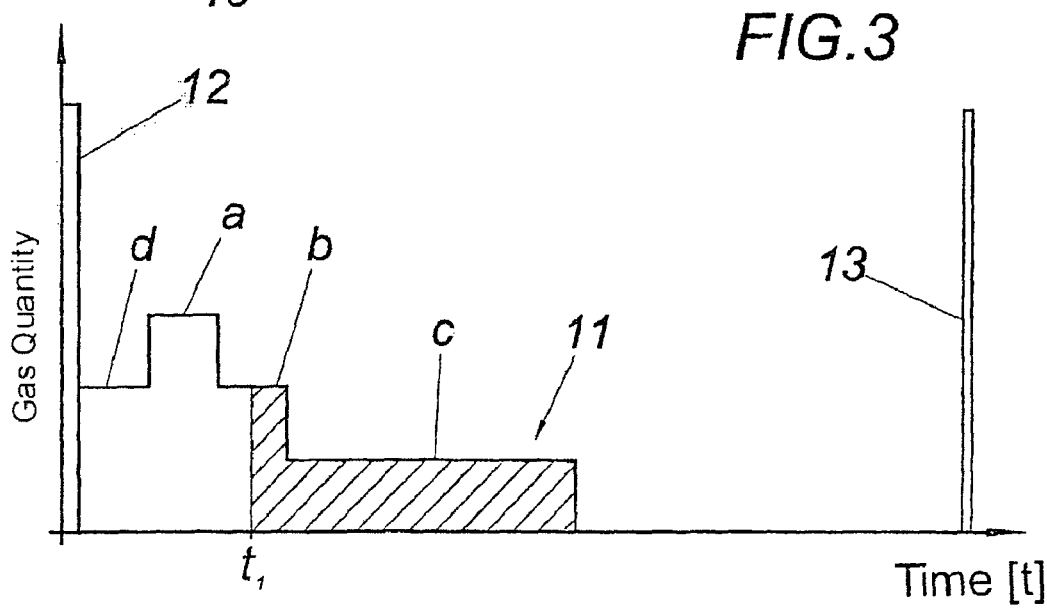
FIG. 3 shows the demand for protective gas occurring during the treatment time.

When the annealing goods are heated in the respective heating chambers 1 after the scavenging process with the help of scavenging gas under protective gas atmosphere, a temperature curve $T_1$ is obtained on the surface of the annealing good according to FIG. 2. Curve $T_2$ indicates the temperature curve in the interior of the annealing good. As a result of the surface heating of the annealing good, lubricant residues adhering to the surface will evaporate, with the vaporizing quantities of impurities increasing strongly with the surface temperature T1 according to curve 9 which indicates the quantities of impurities vaporizing during a vaporization phase 10, which then drops due to the increasing cleaning of the surface and approaches a negligible residual value. This means that in the area of the main occurrence of vaporizing impurities, the largest quantity of protective gas needs to be conveyed through the heating chambers 1 in order to ensure scavenging and thus a dilution of the impurities. FIG. 3 indicates the respectively required quantity of scavenging gas through the stepped curve 11. Section a corresponds to the largest demand for protective gas during the main occurrence of vaporizing impurities. Since said main occurrence of impurities does not need to be diluted and scavenged by non-loaded protective gas from the protective gas line 2, protective gas from storage reservoir 5 is used. This preloaded protective gas which is additionally loaded with the main occurrence of impurities, is drawn off from the heating chamber 1 and is rejected or combusted if it concerns a combustible protective gas. Following section a, the heating chamber 1 is supplied with non-loaded protective gas from the protective gas line 2 during the sections b and c in order to ensure a respective cleaning of the protective gas atmosphere within the heating chambers 1 when the heat treatment is interrupted and the cooling phase is initiated. Since the loading of the protective gas with vaporized impurities decreases with decreasing occurrence of the vaporizing impurities according to the decreasing branch of curve 9, the protective gas which is withdrawn from the heating chamber 1 and which is loaded only slightly with vaporized impurities can be intermediately stored for later use during the main occurrence of vaporizing impurities in a following batch. For this purpose, said protective gas is supplied via line 4 to the compressor 6 for loading the storage reservoir 5. An average loading of the protective gas by the vaporized impurities is obtained in storage reservoir 5 due to the vaporization rate which decreases during the expiry of the vaporization phase 10. To ensure that this average value beneath a predetermined limit value can be maintained, the gas withdrawal from the heating chambers 1 via line 4 can start when the loading of the withdrawn protective gas falls below an upper limit value m which lies 10% above the average share of impurities of the protective gas which is intermediately stored in storage reservoir 5. The loaded protective gas from the storage reservoir 5 can then be used for the start of the vaporization phase 10 of a subsequent batch, namely in the region of sections d and a of the curve 11. Once the upper limit value m for the loading of the protective gas to be withdrawn is reached during the vaporization phase 10 at time $t_1$, the protective gas quantity indicated in FIG. 3 with the hatching can be stored in storage reservoir 5.

When a combustible protective gas such as hydrogen is used as a protective gas, the air cannot be scavenged from the heating chambers 1 before each annealing. Instead it is necessary to use a non-combustible scavenging gas. In FIG. 3, said use of scavenging gas is indicated by curve 12. Similarly, the combustible scavenging gas must be scavenged with the help of a non-combustible scavenging gas prior to the venting of the heating chambers 1 at the end of the cooling phase, as is indicated with curve 13. FIG. 1 shows the scavenging gas feed line with reference numeral 14. The discharge of the scavenging gas is made via line 15.

It is understood that the invention is not limited to the illustrated embodiment. The provision of a storage reservoir 5 could be omitted when charging the heating chambers 1 occurs in a time-staggered manner in such a way that the protective gas quantity withdrawn from time $t_1$ from one of the heating chambers 1 is supplied to the other heating chamber 1, namely during the main occurrence of the vaporizing impurities, so that the required protective gas quantity in the sections d and a of FIG. 3 can be covered at least partly by the protective gas quantity withdrawn from the respectively other heating chamber 1.

It is also possible that the scavenging gas used according to curves 12 and 13 is partly re-used again when said scavenging gases from the heating chamber 1 have a respectively low percentage of impurities which are determined when scavenging the air by atmospheric oxygen and when scavenging the protective gas by the protective gas. The scavenging gas which is loaded to an only comparatively low extent can be used advantageously during one of the following batches at the beginning of the scavenging processes. If the scavenging gas corresponds to the protective gas, then it is understood that it is also possible that the scavenging gas loaded only marginally with impurities is also used during the heat treatment under protective gas atmosphere in the described manner.

The invention claimed is:

1. A method for batchwise heat treatment of goods to be annealed which are heated in a heating chamber after scavenging air with a scavenging gas under protective gas to a predetermined treatment temperature, with the protective gas being conveyed through the heating chamber depending on the occurrence of impurities in different quantities, wherein the protective gas which is withdrawn from the heating chamber after the main occurrence of impurities and which is loaded with a residual quantity of impurities is conveyed, optionally after intermediate storage, into the heating chamber during the main occurrence of impurities of a subsequent batch before non-loaded protective gas is introduced into the heating chamber.

2. A method according to claim 1, wherein the scavenging gas which towards the end of the scavenging process is still loaded with a residual quantity of oxygen is withdrawn from the heating chamber and, optionally after intermediate storage, is conveyed into the heating chamber during a following batch.

3. A method according to claim 1, wherein the protective or scavenging gas which is loaded with impurities is intermediately stored once its percentage of impurities falls below an upper threshold value which lies 10% over the average percentage of contaminations of the intermediate protective or scavenging gas.

* * * * *